US011651461B1

(12) United States Patent
Takacs

(10) Patent No.: US 11,651,461 B1
(45) Date of Patent: May 16, 2023

(54) ARTIFICIAL INTELLIGENCE CRIME LINKING NETWORK

(71) Applicant: Detective Analytics, Toms River, NJ (US)

(72) Inventor: Dean Takacs, Toms River, NJ (US)

(73) Assignee: Detective Analytics, Toms River, NJ (US)

( * ) Notice: Subject to any disclaimer, the term of this patent is extended or adjusted under 35 U.S.C. 154(b) by 0 days.

(21) Appl. No.: 17/652,614

(22) Filed: Feb. 25, 2022

(51) Int. Cl.
*G06Q 50/26* (2012.01)

(52) U.S. Cl.
CPC ..... *G06Q 50/26* (2013.01)

(58) Field of Classification Search
CPC ..... G06Q 50/26
USPC ..... 705/325
See application file for complete search history.

(56) References Cited

U.S. PATENT DOCUMENTS 7,752,154 B2 7/2010 Friedlander et al.
7,805,391 B2 9/2010 Friedlander et al.
7,805,457 B1 9/2010 Viola et al.
7,853,611 B2 12/2010 Friedlander et al.
8,135,740 B2 3/2012 Friedlander et al.
9,110,882 B2 8/2015 Overell et al.
9,152,739 B2 10/2015 Aasen et al.
9,367,872 B1 6/2016 Visbal et al.
9,454,785 B1 9/2016 Hunter et al.
9,483,162 B2 11/2016 Mingione
9,514,200 B2 12/2016 Shankar et al.
2004/0193572 A1* 9/2004 Leary ..... G06Q 99/00
2005/0080806 A1 4/2005 Doganata et al.
2006/0041659 A1 2/2006 Hasan et al.
2011/0225198 A1* 9/2011 Edwards ..... G06Q 50/26 707/E17.014
2014/0040309 A1* 2/2014 Meaney ..... G06Q 50/265 707/769
2015/0052161 A1 2/2015 Boyko et al.
2018/0082202 A1* 3/2018 Vepakomma ..... G06Q 10/063
(Continued)

OTHER PUBLICATIONS

Kari Davies et al., "The practice ofcrime linkage: A review of the literature", Jul. 19, 2019, J Investigative Psychology and Offender Profiling 16:169-200, https://doi.org/10.1002/jip.1531 (Year: 2019).*
(Continued)

*Primary Examiner* — Sangeeta Bahl
*Assistant Examiner* — Joshua D Schneider
(74) *Attorney, Agent, or Firm* — DLA Piper LLP (US)

(57) ABSTRACT

A computing system accesses crime incident data from two or more organization systems. The crime incident data includes a first set of inputs associated with a plurality of crime incident groupings and a second set of inputs associated with incident data for incidents associated with each of the two or more organization systems. The computing system preprocesses the crime incident data to remove incidents that include suspect identifiers not present in at least two or more organization system. The computing system analyzes the preprocessed crime incident data to identify links between incidents across two or more organization systems using a trained crime linking model. The computing system generates a link between a first incident at a first organization system of the two or more organization systems and a second incident at a second organization system based on the analyzing.

20 Claims, 5 Drawing Sheets

(56) References Cited

U.S. PATENT DOCUMENTS

| | | | | |
|---|---|---|---|---|
| 2018/0189913 | A1* | 7/2018 | Knopp | H04W 4/021 |
| 2019/0164245 | A1* | 5/2019 | Takacs | G06Q 30/0205 |

OTHER PUBLICATIONS

James Caverlee et al., "Discovering Interesting Relationships among Deep Web Databases: A Source-Biased Approach", Jul. 14, 2006, World Wide Web, 585-622 (2006). https://doi.org/10.1007/s11280-006-0227-7 (Year: 2006).*

Arthur Vickers et al., "Change Detection and Notifications", Jul. 14, 2021, https://docs.microsoft.com/en-us/ef/core/change-tracking/change-detection (Year: 2021).*

Loss Prevention Media, "Detective Analytics Launches New Crime-Linking Network," Loss Prevention Magazine, https://losspreventionmedia.com/detective-analytics-launches-new-crime-linking-network/, Dec. 13, 2019, 4 pages.

* cited by examiner

ARTIFICIAL INTELLIGENCE CRIME LINKING NETWORK

FIELD OF THE DISCLOSURE

The present disclosure generally relates to an artificial intelligence-based crime linking network and a method of operating the same.

BACKGROUND

For some companies, theft represent a sizable portion of losses such, it would be beneficial if linking incidents of theft was simple enough to render a proper return-on-investment. As it turns out, one might expect, serial offenders and crime organizations are responsible for a significant portion of these crimes. For this reason, there is a great incentive to stop an entity that is likely to continue committing crimes if left unchecked. However, given the time intensive nature of going through the massive amount of incident reports attempting to link them, it is simply not feasible for companies to assign human personnel to go through everything.

SUMMARY

In some embodiments, a method is disclosed herein. A computing system accesses crime incident data from two or more organization systems. The crime incident data includes a first set of inputs associated with a plurality of crime incident groupings and a second set of inputs associated with incident data for incidents associated with each of the two or more organization systems. The computing system preprocesses the crime incident data to remove incidents that include suspect identifiers not present in at least two or more organization system. The computing system analyzes the preprocessed crime incident data to identify links between incidents across two or more organization systems using a trained crime linking model. The computing system generates a link between a first incident at a first organization system of the two or more organization systems and a second incident at a second organization system based on the analyzing.

In some embodiments, a non-transitory computer readable medium. The non-transitory computer readable medium includes one or more sequences of instructions, which, when executed by one or more processors, causes a computing system to perform operations. The operations include accessing, by the computing system, crime incident data from two or more organization systems. The crime incident data includes a first set of inputs associated with a plurality of crime incident groupings and a second set of inputs associated with incident data for incidents associated with each of the two or more organization systems. The operations further include preprocessing, by the computing system, the crime incident data to remove incidents that include suspect identifiers not present in at least two or more organization system. The operations further include analyzing, by the computing system, the preprocessed crime incident data to identify links between incidents across two or more organization systems using a trained crime linking model. The operations further include generating, by the computing system, a link between a first incident at a first organization system of the two or more organization systems and a second incident at a second organization system based on the analyzing.

In some embodiments, a method is disclosed herein. A computing system captures a first snapshot of all elements of a plurality of databases at a first period in time. Each database of the plurality of database associated with an organization computing system. Each database includes data related to a plurality of criminal incidents. The data is related to the plurality of criminal incidents comprising a listing of incident/group pairs and a plurality of incidents. The computing system captures a second snapshot of all elements of the plurality of databases at a second period in time. The second snapshot includes at least one element that is different from the elements of the first snapshot. The computing system compares the second snapshot to the first snapshot to determine whether there was a change to the plurality of databases. Responsive to detecting the change, the computing system notifies an organization associated with the change.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrated only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Both law enforcement and retail companies create incident reports each time suspicious or illegal activity has taken place. Whether the incident reports pertain to the activity that occurs within a branch of a retail store, or a police report disclosing more general criminal activity, tens of millions of these reports are generated each year. However, due to the sheer volume of reports that are generated, many of the reports go unread or are not analyzed.

U.S. application Ser. No. 16/205,104, which is incorporated by reference herein, provides a system for automatically linking incidents related to criminal activity. At a high level, the disclosure utilizes one or more machine-learning algorithms to determine a similarity between at least two incident reports. The system automatically links related incident reports when the pairwise probability is above a predetermined threshold amount. In this manner, clusters of criminal enterprises may be identified.

The one or more techniques described herein continues to build upon the functionality of the foregoing crime-linking software by allowing organizations to share what would otherwise be sensitive criminal activity information. For example, organizations can share information regarding the clusters of criminal enterprises that were identified based on the incident reports generated and maintained by each organization. The sharing of such data across organizations may allow algorithms to further build out or identify members to a criminal enterprise or, in some embodiments, identify linked crimes that would otherwise not be linked by merely looking at the organizational level. Such processes can be done without the organization revealing certain sensitive information contained in their incident reports.

Figure 1:
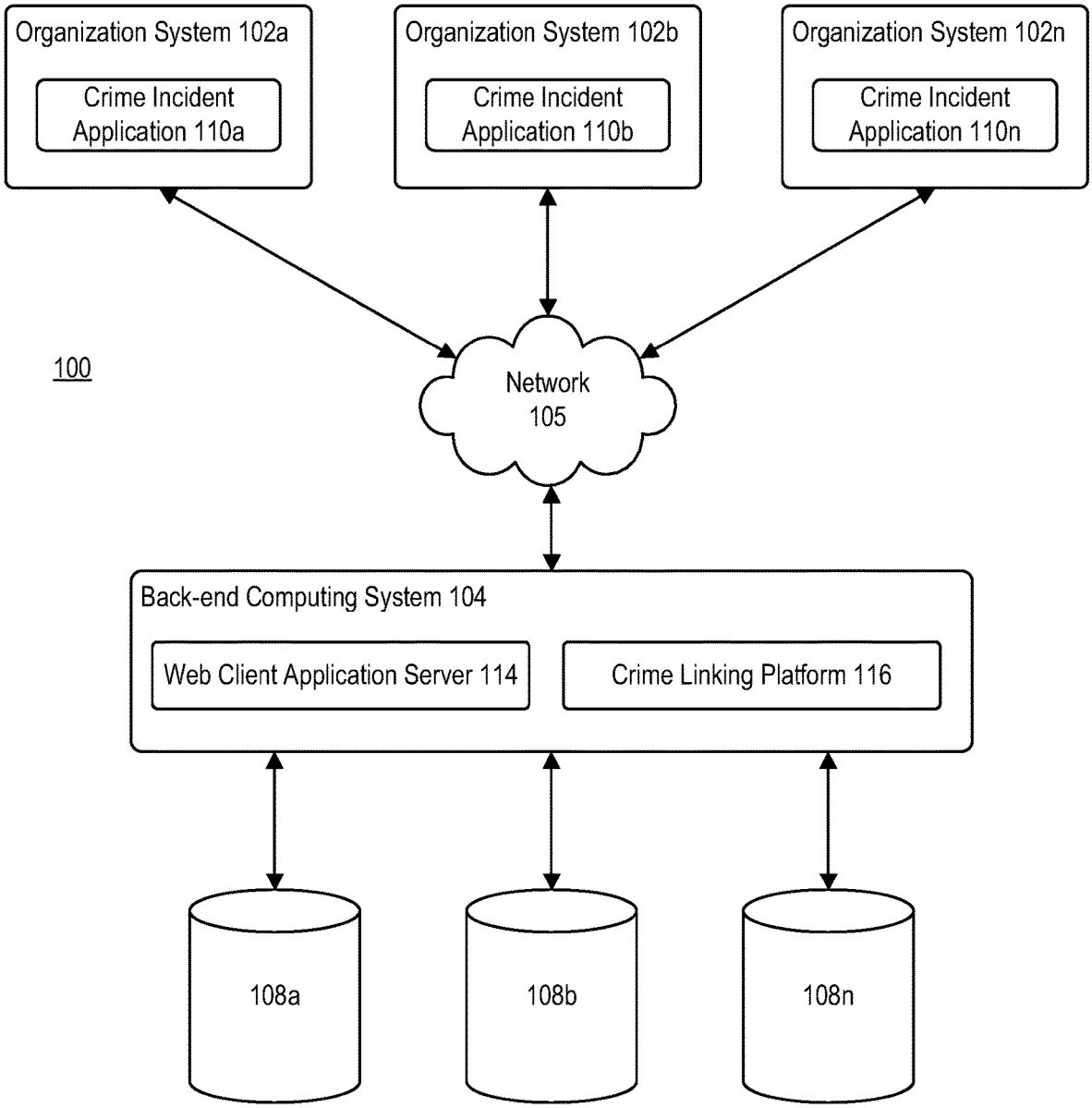
FIG. 1 is a block diagram illustrating a computing environment, according to example embodiments.

FIG. 1 is a block diagram illustrating a computing environment 100, according to example embodiments. Computing environment 100 may include one or more organization systems 102 and a back-end computing system 104 communicating via network 105.

Network 105 may be of any suitable type, including individual connections via the Internet, such as cellular or Wi-Fi networks. In some embodiments, network 105 may connect terminals, services, and mobile devices using direct connections, such as radio frequency identification (RFID), near-field communication (NFC), Bluetooth™, low-energy Bluetooth™ (BLE), Wi-Fi™ ZigBee™, ambient backscatter communication (ABC) protocols, USB, WAN, or LAN. Because the information transmitted may be personal or confidential, security concerns may dictate one or more of these types of connection be encrypted or otherwise secured. In some embodiments, however, the information being transmitted may be less personal, and therefore, the network connections may be selected for convenience over security.

Network 105 may include any type of computer networking arrangement used to exchange data or information. For example, network 105 may be the Internet, a private data network, virtual private network using a public network and/or other suitable connection(s) that enables components in computing environment 100 to send and receive information between the components of environment 100.

One or more organization systems 102 may include organization system 102*a*, organization system 102*b*, and organization system 102*n* (generally, "organization system 102"). Generally, organization systems 102 may be representative of at least two distinct organization systems. Each organization system 102 may be associated with a distinct organization or entity. Generally, each organization system 102 may be representative of one or more computing systems. For example, each organization system 102 may be representative of one or more of a mobile device, a tablet, a desktop computer, or any computing system having the capabilities described herein.

Each organization system 102 may include a crime incident application 110. For example, as shown, organization system 102*a* may include crime incident application 110*a*, organization system 102*b* may include crime incident application 110*b*, and organization system 102*n* may include crime incident application 110*n*. Crime incident application 110 may be representative a standalone application associated with back-end computing system 104. In some embodiments, crime incident application 110 may be representative of a web browser that allows access to a website associated with back-end computing system 104. Organization system 102 may access crime incident application 110 to access content or functionality associated with back-end computing system 104.

In some embodiments, organization system 102 may communicate over network 105 to access crime or incident information associated with the organization. For example, via crime incident application 110, organization system 102 may access individual incident reports as well as groups or clusters of incidents based on analysis from back-end computing system 104. The content that is displayed to organization system 102 may be transmitted from web client application server 114 to organization system 102, and subsequently processed by crime incident application 110 for display through a graphical user interface (GUI) of a computing system associated with organization system 102.

Back-end computing system 104 may include at least a web client application server 114 and crime linking platform 116. Crime linking platform 116 may be comprised of one or more software modules. The one or more software modules may be collections of code or instructions stored on a media (e.g., memory of back-end computing system 104) that represent a series of machine instructions (e.g., program code) that implements one or more algorithmic steps. Such machine instructions may be the actual computer code the processor of back-end computing system 104 interprets to implement the instructions or, alternatively, may be a higher level of coding of the instructions that is interpreted to obtain the actual computer code. The one or more software modules may also include one or more hardware components. One or more aspects of an example algorithm may be performed by the hardware components (e.g., circuitry) itself, rather as a result of the instructions.

Crime linking platform 116 may be configured to identify and/or manage linked incidents related to criminal activity. For example, crime linking platform 116 may be configured to build investigations within an organization and across organizations. However, while conventionally, organizations would have had to share sensitive information across entities, which could result in data leakage of such sensitive information, crime linking platform 116 eliminates this susceptibility.

By identifying links between crimes or criminal entities across organizations, each individual organization may gain a better understanding of linked criminal entities at their individual locations. For example, John Doe and Jane Smith may both be determined to be member of Crime Syndicate One by crime linking platform 116 for organization system 102*a*, but organization system 102*b* is unaware of both John Doe's and Jane Smith's membership to Crime Syndicate One because, for example, organization system 102*b* only includes a single incident report naming John Doe and a separate single incident report naming Jane Smith, with no obvious connection between them. The sharing of information between entities will now provide a better picture of John Doe and Jane Smith to organization system 102*b* by notifying organization system 102*b* that both John Doe and Jane Smith are members of Crime Syndicate One. This links their crimes and allows them to be investigated as a single criminal entity. This is only possible by analyzing information across organizations. The details of crime linking platform 116 may be found below in conjunction with FIG. 2.

In some embodiments, crime linking platform 116 may interface with databases 108*a*-108*n* (generally, "database 108"). Each database 108*a*-108*n* may correspond to a respective organization system 102*a*-102*n*. For example, database 108*a* may be associated with organization system

102*a*; database 108*b* may be associated with organization system 102*b*; and database 108*n* may be associated with organization system 102*n*.

Each database 108 may store two sets of information: a first set of data corresponding to a list of incident/group pairs detected at a respective organization system 102 and a second set of inputs corresponding to detailed data from all incidents detected at organization system 102.

Figure 2:
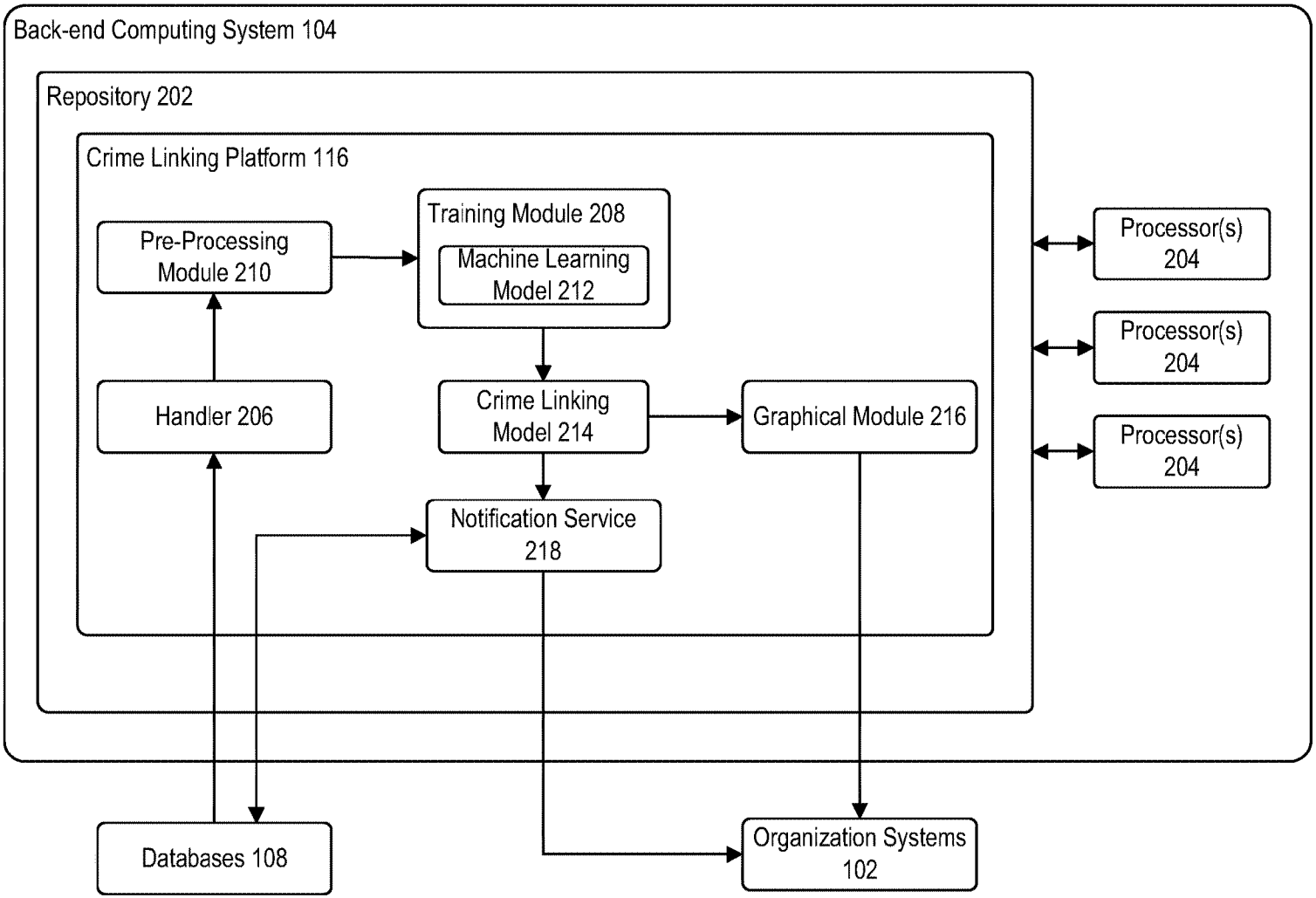
FIG. 2 is a block diagram illustrating back-end computing system, according to example embodiments.

FIG. 2 is a block diagram illustrating back-end computing system 104, according to example embodiments. As shown, back-end computing system 104 includes repository 202 and one or more computer processors 204.

Repository 202 may be representative of any type of storage unit and/or device (e.g., a file system, database, collection of tables, or any other storage mechanism) for storing data. Further, repository 202 may include multiple different storage units and/or devices. The multiple different storage units and/or devices may or may not be of the same type or located at the same physical site. As shown, repository 202 includes at least crime linking platform 116.

Crime linking platform 116 may include a handler 206 and a training module 208. In some embodiments, crime linking platform 116 may further include pre-processing module 210. Each of training module 208 and pre-processing module 210 may be comprised of one or more software modules. The one or more software modules are collections of code or instructions stored on a media (e.g., memory of back-end computing system 104) that represent a series of machine instructions (e.g., program code) that implements one or more algorithmic steps. Such machine instructions may be the actual computer code the processor of back-end computing system 104 interprets to implement the instructions or, alternatively, may be a higher level of coding of the instructions that are interpreted to obtain the actual computer code. The one or more software modules may also include one or more hardware components. One or more aspects of an example algorithm may be performed by the hardware components (e.g., circuitry) itself, rather than as a result of the instructions.

Handler 206 may be configured to retrieve data from databases 108*a*-108*n*. For example, handler 206 may be configured to retrieve two sets of inputs from databases 108*a*-108*n*: a first set of inputs that includes incident/group pairs; and a second set of inputs corresponding to all detected incidents and their detailed information.

As briefly described above, the first set of inputs include a list of incident/group pairs. Each incident/group pair may include a unique incident number and a unique group number into which that incident has been partitioned. For example, handler 206 may retrieve, from database 108*a*, a listing of all incident/group pairs. Exemplary incident/group pairs may include:

TABLE 1

| Organization System 102a |
|---|
| <Group1, 1234> |
| <Group2, 1235> |
| <Group1, 1236> |
| <Group1, 1237> |
| <Group2, 1238> |

As shown, each incident/group pair includes a unique group number and a unique incident number. Considering the first entry for organization system 102*a*, the incident/group pair includes "Group1" as the unique group number and "1234" as the unique incident number. As those skilled in the art understand, the unique group number and unique incident number are merely exemplary.

In operation, the unique group number may be a unique string of alphanumeric characters; similarly, the unique incident number may be a unique string of alphanumeric characters.

In some embodiments, pre-processing module 210 may preprocess the incident/group pairs retrieved from databases 108*a*-108*n*. For example, pre-processing module 210 may concatenate the incident/group pairs to include data indicative of the organization from which they originated. Accordingly, pre-processing module 210 may process Table 1 to output a set that includes:

{<Group1 OrgA, 1234 OrgA>, <Group2 OrgA, 1235 OrgA>, <Group1 OrgA, 1236 OrgA>, <Group1 OrgA, 1237 OrgA>, <Group2 OrgA, 1238 OrgA>}

As provided above, pre-processing module 210 may concatenate an entry in each incident/group pair with an indication of the organization from which the incident/group pair originated. In this manner, incident/group pairs from organization system 102*a* may be combined with incident group pairs from other organization systems 102*b*-102*n*. Accordingly, by appending the organization name to the entry in each incident/group pair, pre-processing module 210 may ensure that the group IDs and incident IDs are unique after combining data from multiple organizations. Further, such process may allow organizations to be recovered from reading the incident numbers in the combined dataset.

For example, assume that handler 206 retrieves the following listing of incident/group pairs from database 108*b* associated with organization system 102*b*:

TABLE 2

| Organization System 102b |
|---|
| <Group4, 4321> |
| <Group5, 5321> |
| <Group4, 6321> |
| <Group5, 8321> |
| <Group3, 9999> |

Similarly, each incident/group pair includes a unique group number and a unique incident number. Considering the first entry for organization system 102*b*, the incident/group pair includes "Group4" as the unique group number and "4321" as the unique incident number. Pre-processing module 210 may further preprocess the incident/group pairs retrieved from databases 108*b*. For example, handler 206 may process Table 2 to output a set that includes:

{<Group4 OrgB, 4321 OrgB>, <Group5 OrgB, 5321 OrgB>, <Group4 OrgB, 6321 OrgB>, <Group5 OrgB, 8321 OrgB>, <Group3 OrgB, 9999 OrgB>

Pre-Processing module 210 may combine the data obtained from database 108*a* with the data obtained from database 108*b* to generate the first set of data. For example, pre-processing module 210 may generate:

{<Group1 OrgA, 1234 OrgA>, <Group2 OrgA, 1235 OrgA>, <Group1 OrgA, 1236 OrgA>, <Group1 OrgA, 1237 OrgA>, <Group2 OrgA, 1238 OrgA>}, {<Group4 OrgB, 4321 OrgB>, <Group5 OrgB, 5321 OrgB>, <Group4 OrgB, 6321 OrgB>, <Group5 OrgB, 8321 OrgB>, <Group3 OrgB, 9999 OrgB>}

Pre-processing module 210 may then further process the combined data set into a single list that captures the minimal link-representation of all groups across organization systems. This is a logically identical representation, but in the form of links, instead of the form of nodes with group designations. Note, in the case of singletons (groups of size 1), this transformed representation requires a single link from the same node to itself. For example, pre-processing module 210 may generate a list that includes:

{<1234 OrgA, 1236 OrgA>, <1236 OrgA, 1237 OrgA>, <1235 OrgA, 1238 OrgA>, <4321 OrgB, 6321 OrgB>, <5321 OrgB, 8321 OrgB>, <9999 OrgB, 9999 OrgB>}

In this manner, pre-processing module 210 may connect incidents within groupings. For example, <1234 OrgA, 1236 OrgA> are grouped because incident 1234 is associated with Group 1 at organization system 102*a* and incident 1236 is associated with Group 1 at organization system 102*a*. Because incident 1237 is also associated with Group 1 at organization system 102*a*, another link is created, <1236 OrgA, 1237 OrgA>, to fully represent this group of size 3.

The second set of inputs may include a list of triples of all suspect identifiers. In some embodiments, each triple may include the unique incident number, the identifier type, and the identifier value. For example, an example triple in the second set of inputs may include: <Identifier type, Identifier_value, and Incident ID>. Exemplary identifier types may include the following unique or quasi-unique representations, but are not limited to full name, date of birth, license plate number, driver's license number, address, credit card number, unique customer ID, customer loyalty number, fingerprint, retinal scan, face map, unique physical gait map, keyboard and mouse usage map, DNA, customer gift registry, social security number, email address, phone number, IP address, physical address, unique employee id, and the like.

For example, handler 206 may retrieve, from database 108*a*, a listing of all triples. Exemplary triples may include:

TABLE 3

| Organization System 102a |
|---|
| <John Doe, name, 1234> |
| <123 Main Street, address, 1234> |
| <987654321, credit card, 1235> |
| <John Doe, name, 1236> |

As shown, each triple includes a suspect identifier value, a suspect identifier type, and a unique incident number. Considering the first entry for organization system 102*a*, the triple includes "John Doe" as the suspect identifier value, "name" as the suspect identifier type, and "1234" as the unique incident number. As those skilled in the art understand, these values are merely exemplary.

In some embodiments, pre-processing module 210 may preprocess the triples retrieved from databases 108*a*-108*n*. For example, pre-processing module 210 may modify the triples to include data indicative of the organization from which they originated. Accordingly, pre-processing module 210 may process Table 3 to output a set that includes: {<John Doe, name, 1234 OrgA>, <123 Main Street, address, 1234 OrgA>, <987654321, credit card, 1235 OrgA>, <John Doe, name, 1236 OrgA>}

As provided above, pre-processing module 210 may modify an entry in each triple to include an indication of the organization from which the incident/group pair originated. In this manner, the incident triples from organization system 102*a* may be combined with incident triples from other organization systems 102*b*-102*n*. For example, assume that handler 206 retrieves the following incident triples from database 108*b* associated with organization system 102*b*:

TABLE 4

| Organization System 102b |
|---|
| <John Doe, name, 4321> |
| <654321987, credit card, 4321> |
| <Pete Doe, name, 5321> |
| <John Doe, name, 6321> |
| <987654321, credit card, 9999> |

Similarly, each incident triple includes a suspect identifier value, a suspect identifier type, and a unique incident identifier. Considering the first entry for organization system 102*b*, the triple includes John Doe as the suspect identifier value, name as the suspect identifier type, and 4321 as the unique incident number. Pre-processing module 210 may further preprocess the triples retrieved from databases 108*b*. For example, pre-processing module 210 may process Table 4 to output a set that includes:

{<John Doe, name, 4321 OrgB>, <654321987, credit card, 4321 OrgB>, <Pete Doe, name, 5321 OrgB>, <John Doe, name, 6321 OrgB>, <987654321, credit card, 9999 OrgB>}

Pre-processing module 210 may combine the data obtained from database 108*a* with the data obtained from database 108*b* to generate the second set of data. For example, pre-processing module 210 may generate:

{<John Doe, name, 1234 OrgA>, <123 Main Street, address, 1234 OrgA>, <987654321, credit card, 1235 OrgA>, <John Doe, name, 1236 OrgA>, <John Doe, name, 4321 OrgB>, <654321987, credit card, 4321 OrgB>, <Pete Doe, name, 5321 OrgB>, <John Doe, name, 6321 OrgB>, <987654321, credit card, 9999 OrgB>}

Pre-processing module 210 may process the combined data set to only include those unique suspect identifiers that are present in at least two organizations. For example, the data set may be reduced to include:

{<John Doe, name, 1234 OrgA>, <987654321, credit card, 1235 OrgA>, <John Doe, name, 1236 OrgA>, <John Doe, name, 4321 OrgB>, <John Doe, name, 6321 OrgB>, <987654321, credit card, 9999 OrgB, >}

Based on this information, pre-processing module 210 may generate all cross-company pairs. In some embodiments, an empty dataset is created. The empty data set may be populated by iterating over every suspect identifier value, for each possible pair of organizations, appending all the unique pairs from the cartesian product of the two sets of all incidents, from each of the pairs of organizations, in which that particular suspect identifier value is present. For example, pre-processing module 210 may further generate the following data set:

<John Doe, name, 1234 OrgA, 4321 OrgB>, <John Doe, name, 1234 OrgA, 6321 OrgB>, <John Doe, name, 1236 OrgA, 4321 OrgB>, <John Doe, name, 1236 OrgA, 6321 OrgB>, <987654321, credit card, 1235 OrgA, 9999 OrgB>

As those skilled in the art understand, the triples may include additional values relevant to the incident that can be used to compute distance measures between the cross-company pairs. These pairwise computed distances can be compared against known distance functions to determine if each cross-company pair meets the distance threshold. This is especially important in the case of "quasi-unique" identifiers, such as names. For example, distance measures may be computed to infer whether the same detected full name might truly be different actual people who happen to share that "quasi-unique" identifier. In some embodiments, an administrator, or machine learning model, may decide that for cross-company pairs matching on names, each pair must be within 100 miles and 100 days of each other, else they are discarded due to an elevated probability that the names are actually different people. For example, a triple may be extended to include, but not limited to, location information (e.g., latitudinal and longitudinal coordinates), date information, and the like. Using a particular example, a triple may be extended to include:

<John Doe, name, 1234 Org1, Lat1, Long1, Date1>

<John Doe, name 4321 Org2, Lat2, Long2, Date2>

Accordingly, when combined, the resultant data object may include:

<John Doe, name, 1234 Org1, 4321 Org2, Lat1, Lat2, Long1, Long2, Date1, Date2 . . . >

Continuing the above example, based on this information, assuming all cross-company pairs computed in the earlier example either meet the distance threshold or no such filter is applied to the cross-company pairs and they are all accepted by default, then the following become the cross-company groups below. As shown, Group1 from OrgA and Group4 from OrgB have merged to form Group11 in the Cross-Company Groups, due to the same suspect identifier name John Smith detected in incidents within both groups that created cross-company links between incidents in those groups. Similarly, Group2 from OrgA has merged with Group3 from OrgB due to the same suspect identifier credit card 987654321 being detected in incidents within both groups that created cross-company links between incidents in those groups. Finally, Group3 from OrgB has not been linked to any other organization. Accordingly, Group3 may remain the same group but may have a different arbitrary GroupID, Group13, assigned to it. Groups 11 and 12 are true cross-company groups, as they have at least 2 or more organizations' incidents within each group.

| Cross-Company Groups |
|---|
| <Group11, 1234OrgA> |
| <Group11, 1236OrgA> |
| <Group11, 1237OrgA> |
| <Group11, 4321OrgB> |
| <Group11, 6321OrgB> |
| <Group12, 1235OrgA> |
| <Group12, 1238OrgA> |
| <Group12, 9999OrgB> |
| <Group13, 5321OrgB> |
| <Group13, 8321OrgB> |

In some embodiments, if at least one link exists between groupings and the link meets the pairwise threshold, then those two groups may be merged. In some embodiments, a more complex threshold function that operates at the group-to-group level may be used. For example, the more complex threshold function may take, as input, a list of any or all possible links between those two groups. In some embodiments, the input may further include the details of incidents in each group. In some embodiments, the input may further include details about the other groups and the other links outside of those two groups. Based on the input, a more complex machine learning trained threshold could be applied to determine whether or not two cross-company groups may be merged.

In some embodiments, rather than handler 206 accessing information stored in databases 108*a*-108*n*, each organization system 102*a*-102*n* may transmit the information to handler 206. In such embodiments, an organization system 102 may choose to encrypt the data prior to transmission to handler. In such embodiments, crime linking model 214 may be configured to process the linked connections without actually being exposed to the suspect identifiers—only the encrypted value, where each organization encrypts using the same key.

Training module 208 may be configured to train a machine learning model 212 to identify related pairs of incidents across organization systems 102. For example, based on the filtered input data from pre-processing module 210 (i.e., input data where each suspect identifier is present in at least two organization systems 102), training module 208 may train machine learning model 212 to identify check if cross-company links meet a sufficient threshold to be accepted. This machine learning model can be dependent on the suspect identifier type, as some types, like social security numbers, are more unique than other types, like suspect full names. The less unique suspect identifier types would then require a more stringent threshold. In some embodiments, machine learning model 212 may be trained on obfuscated data (e.g., the first or second set of inputs are encrypted before being accessed by handler 206). In some embodiments, machine learning model 212 may be trained on the raw data. In some embodiments, machine learning model 212 may be trained to evaluate possible related pairs across cross-company incidents, regardless of whether or not there were matching suspect identifiers. In some embodiments, machine learning model 212 may be trained to validate whether the cross-company links that were computed from shared suspect identifiers meet a sufficient threshold to be accepted. In some embodiments, this machine learning may not be used at all, hence all computed cross-company links, based on matching suspect identifiers, are accepted as valid by default.

Training machine learning model 212 is not a trivial task, however, as not all suspect identifiers are of equal value in determining links across organizations. For example, while a credit card number may be representative of a strongly unique suspect identifier (e.g., the same credit card number in two incidents is highly likely to be from related incidents), a name may be exemplary of a weakly unique suspect identifier (e.g., the name John Smith in two incidents is not certainly determinative of related incidents, as the name John Smith is common).

Instead, training module 208 may train machine learning model 212 to calculate pairwise similarity measures and thresholds between incidents using a plurality of distance and similarity variables. Such variables, also known as dimensions, include: time distance (in days), represented by the absolute values of the date difference; time of day difference, represented by the absolute values of the difference in the hour of the day in which each incident occurred; geographic distance, cosine similarity between two incident write-ups; a measure of gender similarity; a measure of ethnicity similarity; a measure of vehicle model similarity; a measure of eye color similarity; a measure of hair color similarity; a weekend indicator similarity; physical measurement similarity; height similarity; weight similarity; a maximum text quality score, a minimum text quality score, and age similarity. Such techniques are similar to that described in U.S. application Ser. No. 16/205,104, which is incorporated by reference in its entirety.

In some embodiments, the pairwise distance calculations may depend on the frequency of the identifier value (not just the identifier type), such as, for example, in the case of "quasi-unique" identifiers (e.g., full names). In the context of names, for example, this frequency may be found from census data. For example, assume there are two crimes with a detected suspect name that is very common, e.g., Michael Jones. It would be less likely that the two crimes refer to the same person, compared to two crimes with a detected suspect name that is very rare, such as Jebidiah Featheringham. The pairwise threshold function could be such that it is inversely proportional to the frequency of the particular ID that is responsible for the linking. For example, machine learning model 212 may utilize a threshold function like geo_dist*sqrt(frequency)<5,000, with 5,000 as the cutoff value chosen for this particular threshold function, which is the upper limit above which pairs may be discarded for not meeting the distance threshold.

To further this example, if the frequency of the name Michael Jones is 10,000 in the United States and the frequency of Jebidiah Featheringham is 100 in the United States, then using this formula, for any two crimes associated with Michael Jones to be linked, they must occur within 50 miles of each other. In comparison, for any two crimes in which Jebidiah Featheringham is detected, they must occur within 500 miles to be linked.

In some embodiments, machine learning model 212 may be representative of one or more of a binary regression model and/or a Siamese-trained pair of neural networks. In some embodiments, machine learning model 212 may be representative of one or more of machine learning models or algorithms that may include, but are not limited to, random forest model, support vector machines, neural networks, deep learning models, Bayesian algorithms, Temporal Convolutional Networks, and the like.

Once trained, crime linking model 214 may be deployed within crime linking platform 116 for analysis.

In some embodiments, crime linking platform 116 may further include graphical module 216. Graphical module 216 may be configured to generate a graphical representation of the crime links determined by crime linking model 214. In some embodiments, graphical module 216 may generate a connected graph that visually depicts how suspects are related to each other. In some embodiments, graphical module 216 may utilize one or more external services to generate the connected graph.

In some embodiments, crime linking platform 116 may further include notification service 218. In some embodiments, notification service 218 may be configured to detect when changes are made to an intra-organization incidents. For example, notification service 218 may be configured to automatically detect changes to a grouping of criminal incidents within an organization. More broadly, in another example, notification service 218 may be configured to automatically detect any change to an organization's database. For example, notification service 218 may be configured to monitor database 108 (e.g., database 108*a*, database 108*b*, database 108*n*, etc.) to identify any changes. In some embodiments, a change may be representative of a new incident, a new grouping of incidents, a new addition to a grouping of incidents, a merging of two or more previous groupings, a splitting of a previously intact grouping, a newly identified suspect identifier, and the like. In some embodiments, notification service 218 may be configured to automatically detect changes to the groupings of criminal incidents across organizations. For example, notification service 218 may automatically detect changes to the groupings of criminal incidents based on output from crime linking model 214.

To identify changes to groupings of criminal incidents, notification service 218 may be configured to take a snapshot of all elements and their associated groupings at a first point in time. For example, notification service 218 may access databases 108*a*-108*n* and take a snapshot of all elements related to a plurality of criminal incidents maintained by databases 108*a*-108*n*. The elements related to the plurality of criminal incidents may include, for example, the first set of inputs that include a list of all incident numbers/their corresponding group identifier doubles at a prior timestamp and the second set of inputs corresponding to list of all incident numbers/their corresponding group id doubles at a later timestamp. This may additionally apply to the cross-organization groupings, as well as the individual intra-organization groupings.

At a later point in time (i.e., after the first snapshot), notification service 218 may capture a second snapshot of all elements and their associated groupings. For example, notification service 218 may re-access databases 108*a*-108*n* and take a second snapshot of all elements related to a plurality of criminal incidents maintained by databases 108*a*-108*n*. Following the second snapshot, notification service 218 may compare the second snapshot to the first snapshot to identify those groupings that have been changed. For example, notification service 218 may analyze the groupings information on an element-by-element basis to identify changes to databases 108*a*-108*n*. Notification service 218 may discard those elements that have gone unchanged. This may additionally apply to the cross-organization groupings, as well as the individual intra-organization groupings.

In some embodiments, notification service 218 may further analyze a subset of grouping that have changed (i.e., the "changed groups") between snapshots to: (1) determine whether the changed group is a strict subset of an existing group in the first snapshot; and (2) determine whether the changed group is a strict superset of at least one group. If, for example, notification service 218 determines that the changed group is a strict subset of an existing group in the first snapshot, then notification service 218 may conclude that the grouping has changed because a previous grouping has broken apart. This typically happens when previously erroneously detected and matching suspect identifiers are updated and no longer match across those same incidents, thus breaking apart the connections between the incidents in that group.

If, for example, notification service 218 determines that the changed group is a strict superset of at least one group, then notification service 218 may conclude that the change to the changed group should be stored for each underlying group.

In some embodiments, notification service 218 may allow for new incident data to enter the system over time, thus increasing the size of the set of total incidents which must be partitioned into groups, from one period to another. In some embodiments, notification service 218 may allow for some incident data to be deleted from the system over time, thus decreasing the size of the set of total incidents which must be partitioned into groups, from one period to another. In some embodiments, notification service 218 may allow for the omission of unchanged groups from being sent out as alerts. In some embodiments, notification service 218 may allow for the omission of groups of size 1 from being sent out as alerts. In some embodiments, notification service 218 may allow for the omission of groups of size less than an arbitrary small value, n, from being sent out as alerts. In some embodiments, notification service 218 allows for the omission of groups of some cumulative measure, for example sum of dollar value, less than an arbitrary small value, n, from being sent out as alerts.

Notification service 218 may be configured to send a message to each affected organization system 102 based on the detected change. In some embodiments, notification service 218 may alert affected organizations if, for example, such analysis detected a change between cross-organization investigations.

In some embodiments, service 218 allows for the selective subscription, by users of the system, to a subset of alerts, based on characteristics of the changed groups, such as location in which the groups struck or total size of groups.

Figure 3:
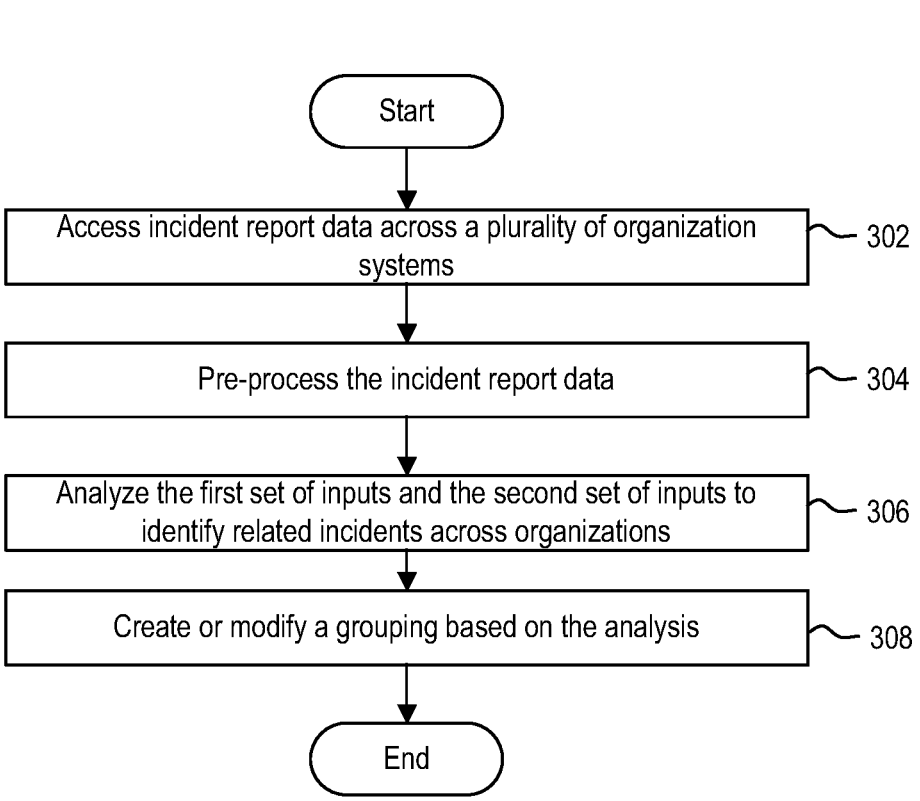
FIG. 3 is a flow diagram illustrating a method of identifying crime incident groupings across organizations, according to example embodiments.

FIG. 3 is a flow diagram illustrating a method 300 of identifying crime incident groupings across organizations, according to example embodiments. Method 300 may begin at step 302.

At step 302, back-end computing system 104 may retrieve or receive incident data across a plurality of organization systems 102. In some embodiments, crime linking platform 116 may retrieve incident data across a plurality of organization systems 102 by accessing databases of each respective organization system 102. For example, crime linking platform 116 may access each of database 102*a*-102*n*.

In some embodiments, crime linking platform 116 may receive incident data from each of the plurality of organizations systems 102. For example, each organization system 102 may upload incident data via one or more application programming interfaces (APIs) associated with back-end computing system 104.

In some embodiments, crime linking platform 116 may receive obfuscated incident data from one or more organization systems 102. For example, an organization system 102 may hash their incident data before uploading the hashed incident data to crime linking platform 116 for analysis.

In some embodiments, the incident data received or retrieved from each organization system 102 may include a first set of inputs that include a list of incidents and their corresponding group id membership pairs and a second set of inputs corresponding to all detected incidents and their details. The first set of inputs may include a list of incident/group pairs for each incident. Each incident/group pair may include a unique incident number and a unique group number that each incident has been partitioned into. The second set of inputs may include a plurality of triples for each detected suspect identifier and the incident number corresponding to the detected suspect identifier. In some embodiments, a particular unique suspect identifier may be detected in more than one incident. In such embodiments, there would be one entry for each incident in which the suspect identifier was detected. In some embodiments, a particular incident might not include any suspect identifiers. In such embodiments, an incident number would not appear in any entries. In some embodiments, a particular incident might include more than one unique detected suspect identifier. In such embodiments, that particular incident number would appear in an entry for each unique suspect identifier that was detected in that particular incident. In some embodiments, each triple may include the unique incident numbers, the identifier type, and the identifier value.

In some embodiments, method 300 may include step 304. At step 304, back-end computing system 104 may pre-process the incident data. For example, pre-processing module 210 may perform one or more pre-processing operations to the first set of inputs and the second set of inputs, such as those described in conjunction with FIG. 2. Following modification to the first set of inputs and the second set of inputs, pre-processing module 210 may analyze inputs to remove those incidents that includes suspect identifiers not present in more than one organization system 102.

At step 306, back-end computing system 104 may analyze the first set of inputs and the second set of inputs to identify related incidents across organizations. For example, crime linking model 214 may receive, as input, the pre-processed first set of inputs and the pre-processed second set of inputs.

At step 308, back-end computing system 104 may create or modify a grouping based on the analysis. For example, responsive to identifying a suspect identifier that is present across two or more organization systems 102, crime linking model 214 may create a linkage between a first group associated with that particular suspect identifier at a first organization system (e.g., organization system 102*a*) and a second group associated with that same particular suspect identifier at a second organization system (e.g., organization system 102*b*).

Figure 4:
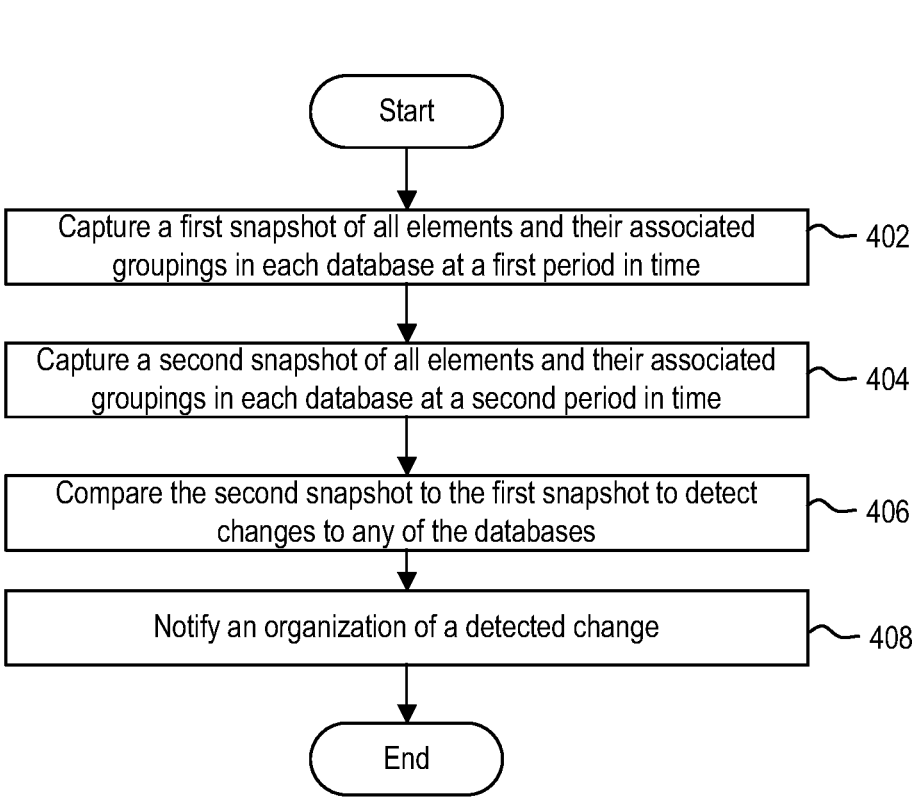
FIG. 4 is a flow diagram illustrating a method of generating crime linking notifications, according to example embodiments.

FIG. 4 is a flow diagram illustrating a method 400 of generating crime linking notifications, according to example embodiments. Method 400 may begin at step 402.

At step 402, back-end computing system 104 may capture a first snapshot of all elements and their associated groupings in each database 108 at a first period in time. For example, notification service 218 may access databases 108*a*-108*n* to take a snapshot of all elements related to a plurality of criminal incidents maintained therein. In some embodiments, the elements related to the plurality of criminal incidents may include, for example, the first set of inputs that include a list of doubles for the incident numbers and their corresponding unique group membership ID.

At step 404, back-end computing system 104 may capture a second snapshot of all elements and their associated groupings in each database 108 at a second period in time. The second period in time is after the first period in time. Notification service 218 may re-access databases 108*a*-108*n* to take a second snapshot of all elements related to a plurality of criminal incidents maintained therein at the second period in time.

At step 406, back-end computing system 104 may compare the second snapshot captured at a second period in time to the first snapshot captured at a first period in time to determine whether there was a change to any of groupings 108*a*-108*n*. For example, notification service 218, may compare each unique grouping, and that groups set of incidents, in the second snapshot to each element unique grouping, and that groups set of incidents in the first snapshot to identify those groupings that have changed, have been added to, merged together, split apart, or the like. Using a specific example, notification service 218 may determine that a grouping at organization system 102*a* has grown based on a comparison between a second snapshot of database 108*a* and a first snapshot of database 108*a*. Using another example, notification service 218 may determine that a cross-organization system link has been created based on a comparison between a second snapshot of databases 108*a*-108*n* to a first snapshot of databases 108*a*-108*n*.

At step 408, back-end computing system 104 may notify an organization of the detected change. In those embodiments in which there was an intra-organization change, notification service 218 may generate a notification that notifies the organization of the detected change and explains the identified change. For example, notification service 218 may notify organization system 102*a* that Group1 has been expanded to include Incident 6565 based on the suspect identifier value "XYZ789, License Plate Number." In those embodiments in which a cross-organization change was detected, notification service 218 may generate a notification that notifies each organization of the detected change. However, in some embodiments, because crime linking platform 116 obfuscates suspect identifiers from other organizations, notification service 218 may not include the suspect identifier value that triggered the cross-organization change. In this embodiment, for each cross-company detected group, the system will only share the incident numbers and the corresponding company name for each incident. In this way, the system ensures that no sensitive data is exchanged, while still allowing for the sharing of actionable intelligence.

Figure 5A:
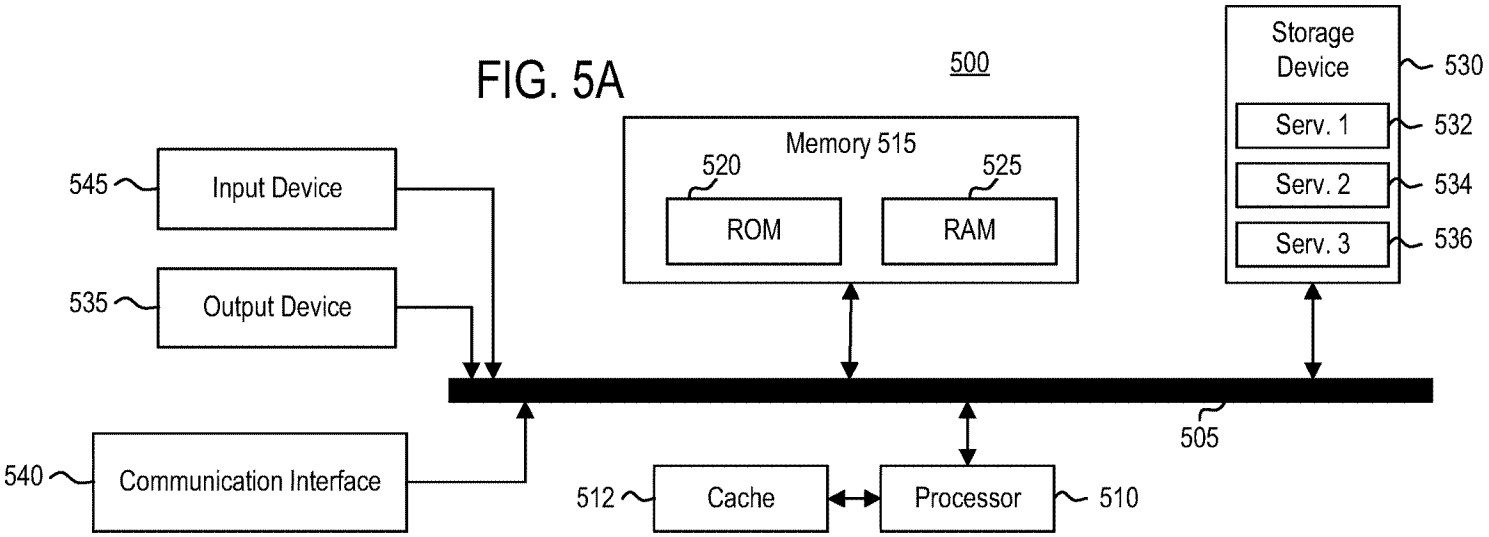
FIG. 5A is a block diagram illustrating a computing device, according to example embodiments.

FIG. 5A illustrates a system bus architecture of computing system 500, according to example embodiments. System 500 may be representative of at least a portion of back-end computing system 104. One or more components of system 500 may be in electrical communication with each other using a bus 505. System 500 may include a processing unit (CPU or processor) 510 and a system bus 505 that couples various system components including the system memory 515, such as read only memory (ROM) 520 and random access memory (RAM) 525, to processor 510. System 500 may include a cache of high-speed memory connected directly with, in close proximity to, or integrated as part of processor 510. System 500 may copy data from memory 515 and/or storage device 530 to cache 512 for quick access by processor 510. In this way, cache 512 may provide a performance boost that avoids processor 510 delays while waiting for data. These and other modules may control or be configured to control processor 510 to perform various actions. Other system memory 515 may be available for use as well. Memory 515 may include multiple different types of memory with different performance characteristics. Processor 510 may include any general purpose processor and a hardware module or software module, such as service 1 532, service 2 534, and service 3 536 stored in storage device 530, configured to control processor 510 as well as a special-purpose processor where software instructions are incorporated into the actual processor design. Processor 510 may essentially be a completely self-contained computing system, containing multiple cores or processors, a bus, memory controller, cache, etc. A multi-core processor may be symmetric or asymmetric.

To enable user interaction with the computing system 500, an input device 545 may represent any number of input mechanisms, such as a microphone for speech, a touch-sensitive screen for gesture or graphical input, keyboard, mouse, motion input, speech and so forth. An output device 535 may also be one or more of a number of output mechanisms known to those of skill in the art. In some instances, multimodal systems may enable a user to provide multiple types of input to communicate with computing system 500. Communications interface 540 may generally govern and manage the user input and system output. There is no restriction on operating on any particular hardware arrangement and therefore the basic features here may easily be substituted for improved hardware or firmware arrangements as they are developed.

Storage device 530 may be a non-volatile memory and may be a hard disk or other types of computer readable media which may store data that are accessible by a computer, such as magnetic cassettes, flash memory cards, solid state memory devices, digital versatile disks, cartridges, random access memories (RAMs) 525, read only memory (ROM) 520, and hybrids thereof.

Storage device 530 may include services 532, 534, and 536 for controlling the processor 510. Other hardware or software modules are contemplated. Storage device 530 may be connected to system bus 505. In one aspect, a hardware module that performs a particular function may include the software component stored in a computer-readable medium in connection with the necessary hardware components, such as processor 510, bus 505, output device 535 (e.g., display), and so forth, to carry out the function.

Figure 5B:
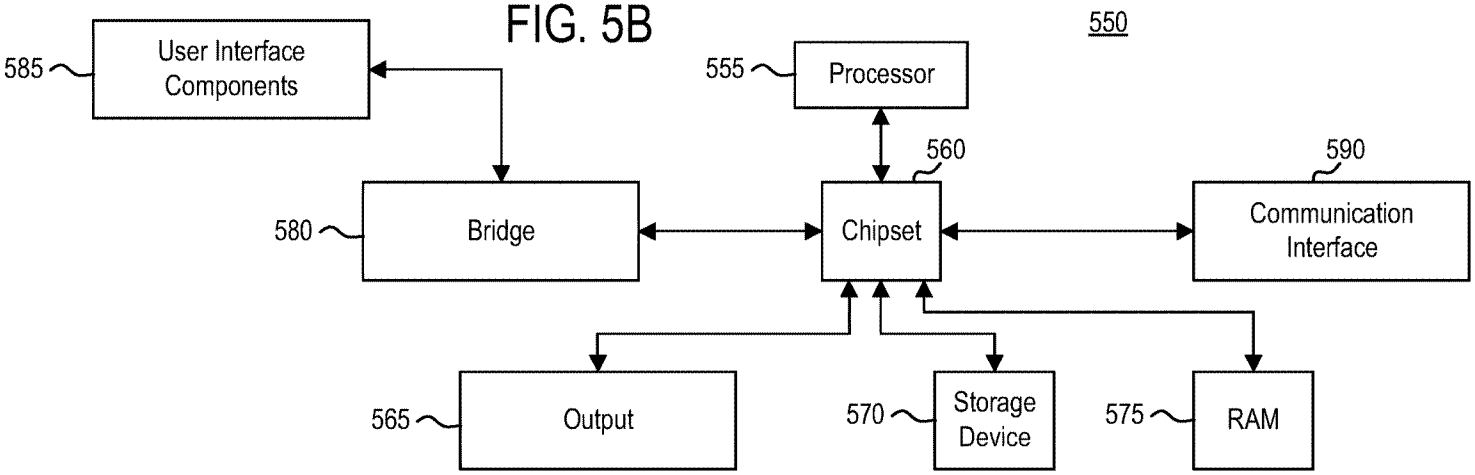
FIG. 5B is a block diagram illustrating a computing device, according to example embodiments.

FIG. 5B illustrates a computer system 550 having a chipset architecture that may represent at least a portion of back-end computing system 104. Computer system 550 may be an example of computer hardware, software, and firmware that may be used to implement the disclosed technology. System 550 may include a processor 555, representative of any number of physically and/or logically distinct resources capable of executing software, firmware, and hardware configured to perform identified computations. Processor 555 may communicate with a chipset 560 that may control input to and output from processor 555. In this example, chipset 560 outputs information to output 565, such as a display, and may read and write information to storage device 570, which may include magnetic media, and solid state media, for example. Chipset 560 may also read data from and write data to storage device 575 (e.g., RAM). A bridge 580 for interfacing with a variety of user interface components 585 may be provided for interfacing with chipset 560. Such user interface components 585 may include a keyboard, a microphone, touch detection and processing circuitry, a pointing device, such as a mouse, and so on. In general, inputs to system 550 may come from any of a variety of sources, machine generated and/or human generated.

Chipset 560 may also interface with one or more communication interfaces 590 that may have different physical interfaces. Such communication interfaces may include interfaces for wired and wireless local area networks, for broadband wireless networks, as well as personal area networks. Some applications of the methods for generating, displaying, and using the GUI disclosed herein may include receiving ordered datasets over the physical interface or be generated by the machine itself by processor 555 analyzing data stored in storage device 570 or storage device 575. Further, the machine may receive inputs from a user through user interface components 585 and execute appropriate functions, such as browsing functions by interpreting these inputs using processor 555.

It may be appreciated that example systems 500 and 550 may have more than one processor 510 or be part of a group or cluster of computing devices networked together to provide greater processing capability.

While the foregoing is directed to embodiments described herein, other and further embodiments may be devised without departing from the basic scope thereof. For example, aspects of the present disclosure may be implemented in hardware or software or a combination of hardware and software. One embodiment described herein may be implemented as a program product for use with a computer system. The program(s) of the program product define functions of the embodiments (including the methods described herein) and can be contained on a variety of computer-readable storage media. Illustrative computer-readable storage media include, but are not limited to: (i) non-writable storage media (e.g., read-only memory (ROM) devices within a computer, such as CD-ROM disks readably by a CD-ROM drive, flash memory, ROM chips, or any type of solid-state non-volatile memory) on which information is permanently stored; and (ii) writable storage media (e.g., floppy disks within a diskette drive or hard-disk drive or any type of solid state random-access memory) on which alterable information is stored. Such computer-readable storage media, when carrying computer-readable instructions that direct the functions of the disclosed embodiments, are embodiments of the present disclosure.

It will be appreciated to those skilled in the art that the preceding examples are exemplary and not limiting. It is intended that all permutations, enhancements, equivalents, and improvements thereto are apparent to those skilled in the art upon a reading of the specification and a study of the drawings are included within the true spirit and scope of the present disclosure. It is therefore intended that the following appended claims include all such modifications, permutations, and equivalents as fall within the true spirit and scope of these teachings.

The invention claimed is:

1. A method, comprising:

accessing, by a computing system, first crime incident data from stored in a first database associated with a first organization system, the first crime incident data comprising a first set of inputs associated with a plurality of crime incident groupings and a second set of inputs associated with incident data for incidents associated with the first organization system;

accessing, by the computing system, second crime incident data stored in a second database associated with a second organization system, the second crime incident data comprising a further first set of inputs associated with a further plurality of crime incident groupings and a further second set of inputs associated with further incident data for further incidents associated with the second organization system, wherein the second database is accessible to the second organization system and is inaccessible to the first organization system;

preprocessing, by the computing system, the first crime incident data and the second crime incident data to remove incidents comprising suspect identifiers not present in both the first database and the second database;

analyzing, by the computing system, the preprocessed first crime incident data and the preprocessed second crime incident data to identify links between incidents across the first organization system and the second organization system using a trained crime linking model, the trained crime linking model trained to identify links between incidents across the first organization system and the second organization system using pairwise similarity measures based on a uniqueness level of identifiers in the preprocessed first crime incident data and the preprocessed second crime incident data;

generating, by the computing system, an association between a first incident at the first organization system and a second incident at the second organization system based on the analyzing;

generating, by the computing system, a graphical representation of the association between the first incident at the first organization system and the second incident at the second organization system;

causing, by the computing system, display of a first version of the graphical representation in a first computing device associated with the first organization system, the first version of the graphical representation at least partially obfuscating data associated with the second incident; and causing, by the computing system, display of a second version of the graphical representation in a second computing device associated with the second organization system, the second version of the graphical representation at least partially obfuscating data associated with the first incident.

2. The method of claim 1, wherein the first crime incident data or the second crime incident data comprises obfuscated crime incident data.

3. The method of claim 1, wherein the first set of inputs comprises incident group pairs, each incident group pair comprising a unique incident number and a unique group number that each incident has been partitioned into.

4. The method of claim 3, wherein the second set of inputs comprise a list of triples for each incident, each triple comprising the unique incident number, an identifier type, and an identifier value.

5. The method of claim 1, further comprising:

determining, by the computing system, that a crime incident grouping of the plurality of crime incident groupings has changed based on the association generated between the first incident and the second incident; and based on the determining, automatically notifying, by the computing system, the first organization system and the second organization system of the association.

6. The method of claim 5, wherein determining, by the computing system, that the crime incident grouping of the plurality of crime incident groupings has changed based on the association generated between the first incident and the second incident comprises:

capturing a first snapshot of a corpus of criminal incident elements a first point in time;

capturing a second snapshot of the corpus of criminal incident elements a second point in time; and comparing the second snapshot to the first snapshot to determine whether the crime incident grouping has changed.

7. The method of claim 6, wherein determining, by the computing system, that the crime incident grouping of the plurality of crime incident groupings has changed based on the association generated between the first incident and the second incident comprises:

determining that the crime incident grouping has changed based on a determination that the crime incident grouping is a strict subset of an existing grouping in the first snapshot.

8. The method of claim 6, wherein determining, by the computing system, that the crime incident grouping of the plurality of crime incident groupings has changed based on the association generated between the first incident and the second incident comprises:

determining that the crime incident grouping has changed based on a determination that the crime incident grouping is a strict superset of an existing grouping in the first snapshot.

9. A non-transitory computer readable medium comprising one or more sequences of instructions, which, when executed by one or more processors, causes a computing system to perform operations comprising:

accessing, by the computing system, first crime incident data from stored in a first database associated with a first organization system, the first crime incident data comprising a first set of inputs associated with a plurality of crime incident groupings and a second set of inputs associated with incident data for incidents associated with the first organization system;

accessing, by the computing system, second crime incident data stored in a second database associated with a second organization system, the second crime incident data comprising a further first set of inputs associated with a further plurality of crime incident groupings and a further second set of inputs associated with further incident data for further incidents associated with the second organization system, wherein the second database is accessible to the second organization system and is inaccessible to the first organization system;

preprocessing, by the computing system, the first crime incident data and the second crime incident data to remove incidents comprising suspect identifiers not present in both the first database and the second database;

analyzing, by the computing system, the preprocessed first crime incident data and the preprocessed second crime incident data to identify links between incidents across the first organization system and the second organization system using a trained crime linking model, the trained crime linking model trained to identify links between incidents across the first organization system and the second organization system using pairwise similarity measures based on a uniqueness level of identifiers in the preprocessed first crime incident data and the preprocessed second crime incident data;

generating, by the computing system, an association between a first incident at the first organization system and a second incident at the second organization system based on the analyzing;

generating, by the computing system, a graphical representation of the association between the first incident at the first organization system and the second incident at the second organization system;

causing, by the computing system, display of a first version of the graphical representation in a first computing device associated with the first organization system, the first version of the graphical representation at least partially obfuscating data associated with the second incident; and causing, by the computing system, display of a second version of the graphical representation in a second computing device associated with the second organization system, the second version of the graphical representation at least partially obfuscating data associated with the first incident.

10. The non-transitory computer readable medium of claim 9, wherein the first crime incident data or the second crime incident data comprises obfuscated crime incident data.

11. The non-transitory computer readable medium of claim 9, wherein the first set of inputs comprises incident group pairs, each incident group pair comprising a unique incident number and a unique group number that each incident has been partitioned into.

12. The non-transitory computer readable medium of claim 11, wherein the second set of inputs comprise a list of triples for each incident, each triple comprising the unique incident number an identifier type, and an identifier value.

13. The non-transitory computer readable medium of claim 9, further comprising:

determining, by the computing system, that a crime incident grouping of the plurality of crime incident groupings has changed based on the association generated between the first incident and the second incident; and based on the determining, automatically notifying, by the computing system, the first organization system and the second organization system of the association.

14. The non-transitory computer readable medium of claim 13, wherein determining, by the computing system, that the crime incident grouping of the plurality of crime incident groupings has changed based on the association generated between the first incident and the second incident comprises:

capturing a first snapshot of a corpus of criminal incident elements a first point in time;

capturing a second snapshot of the corpus of criminal incident elements a second point in time; and comparing the second snapshot to the first snapshot to determine whether the crime incident grouping has changed.

15. The non-transitory computer readable medium of claim 14, wherein determining, by the computing system, that the crime incident grouping of the plurality of crime incident groupings has changed based on the association generated between the first incident and the second incident comprises:

determining that the crime incident grouping has changed based on a determination that the crime incident grouping is a strict subset of an existing grouping in the first snapshot.

16. The non-transitory computer readable medium of claim 14, wherein determining, by the computing system, that the crime incident grouping of the plurality of crime incident groupings has changed based on the association generated between the first incident and the second incident comprises:

determining that the crime incident grouping has changed based on a determination that the crime incident grouping is a strict superset of an existing grouping in the first snapshot.

17. A system, comprising:

a processor; and a memory having programming instructions stored thereon, which, when executed by the processor, causes the system to perform operations comprising:

accessing first crime incident data from stored in a first database associated with a first organization system, the first crime incident data comprising a first set of inputs associated with a plurality of crime incident groupings and a second set of inputs associated with incident data for incidents associated with the first organization system;

accessing second crime incident data stored in a second database associated with a second organization system, the second crime incident data comprising a further first set of inputs associated with a further plurality of crime incident groupings and a further second set of inputs associated with further incident data for further incidents associated with the second organization system, wherein the second database is accessible to the second organization system and is inaccessible to the first organization system;

preprocessing the first crime incident data and the second crime incident data to remove incidents comprising suspect identifiers not present in both the first database and the second database;

analyzing the preprocessed first crime incident data and the preprocessed second crime incident data to identify links between incidents across the first organization system and the second organization system using a trained crime linking model, the trained crime linking model trained to identify links between incidents across the first organization system and the second organization system using pairwise similarity measures based on a uniqueness level of identifiers in the preprocessed first crime incident data and the preprocessed second crime incident data;

generating an association between a first incident at the first organization system and a second incident at the second organization system based on the analyzing;

generating a graphical representation of the association between the first incident at the first organization system and the second incident at the second organization system;

causing display of a first version of the graphical representation in a first computing device associated with the first organization system, the first version of the graphical representation at least partially obfuscating data associated with the second incident; and causing display of a second version of the graphical representation in a second computing device associated with the second organization system, the second version of the graphical representation at least partially obfuscating data associated with the first incident.

18. The system of claim 17, wherein the operations further comprise:

determining that a crime incident grouping of the plurality of crime incident groupings has changed based on the association generated between the first incident and the second incident; and based on the determining, automatically notifying the first organization system and the second organization system of the association.

19. The system of claim 18, wherein determining that the crime incident grouping of the plurality of crime incident groupings has changed based on the association generated between the first incident and the second incident comprises:

capturing a first snapshot of a corpus of criminal incident elements a first point in time;

capturing a second snapshot of the corpus of criminal incident elements a second point in time; and comparing the second snapshot to the first snapshot to determine whether the crime incident grouping has changed.

20. The system of claim 19, wherein determining that the crime incident grouping of the plurality of crime incident groupings has changed based on the association generated between the first incident and the second incident comprises:

determining that the crime incident grouping has changed based on a determination that the crime incident grouping is a strict subset or strict superset of an existing grouping in the first snapshot.

* * * * *